US006968241B2

(12) United States Patent
Vonnoe et al.

(10) Patent No.: US 6,968,241 B2
(45) Date of Patent: Nov. 22, 2005

(54) DEVICE AND METHOD FOR CONTROLLING THE POSITION FOR WORKING DEVICES OF MOBILE MACHINES

(75) Inventors: Reinhard Vonnoe, Weissenhorn (DE); Michael Brand, Ulm (DE)

(73) Assignee: Brueninghaus Hydromatik GmbH, Elchingen (DE)

( * ) Notice: Subject to any disclaimer, the term of this patent is extended or adjusted under 35 U.S.C. 154(b) by 319 days.

(21) Appl. No.: 10/130,728

(22) PCT Filed: Dec. 28, 2000

(86) PCT No.: PCT/EP00/13310

§ 371 (c)(1),
(2), (4) Date: May 20, 2002

(87) PCT Pub. No.: WO01/51717

PCT Pub. Date: Jul. 19, 2001

(65) Prior Publication Data

US 2002/0173900 A1 Nov. 21, 2002

(30) Foreign Application Priority Data

Jan. 11, 2000 (DE) ..... 100 00 771

(51) Int. Cl.[7] ..... G05B 19/18

(52) U.S. Cl. ..... 700/61; 700/64; 700/186; 700/192; 700/193; 700/194; 701/50; 701/49; 340/684; 340/685; 340/689; 340/683.3; 37/414; 37/416; 414/697; 414/699; 414/701

(58) Field of Search ..... 700/61; 701/50; 340/684, 685, 689, 683.3; 37/414, 416; 414/697, 414/699, 701

(56) References Cited

U.S. PATENT DOCUMENTS

| | | | | |
|---|---|---|---|---|
| 525,177 | A | 8/1894 | Daniel | |
| 3,905,500 | A | 9/1975 | Bourges | |
| 4,081,033 | A | 3/1978 | Bulger et al. | |
| 4,514,796 | A * | 4/1985 | Saulters et al. | 700/13 |
| 4,535,847 | A | 8/1985 | Hasegawa et al. | |
| 4,677,579 | A * | 6/1987 | Radomilovich | 702/174 |
| 5,257,177 | A * | 10/1993 | Bach et al. | 700/61 |
| 2001/0044685 | A1 * | 11/2001 | Schubert | 701/50 |

FOREIGN PATENT DOCUMENTS

| | | |
|---|---|---|
| DE | 24 49 839 | 4/1975 |
| DE | 29 23 030 C2 | 12/1980 |

(Continued)

*Primary Examiner*—Anthony Knight
*Assistant Examiner*—Thomas Pham
(74) *Attorney, Agent, or Firm*—Scully, Scott, Murphy & Presser

(57) ABSTRACT

The invention relates to a device for controlling the position for work devices (41) of mobile machines (40). The inventive device comprises a measuring device (1,2) for measuring an angle (α) which is formed between a level (42) that is determined by the position of the work device (41) and the direction of the gravitational force (g). The inventive device also comprises an angle transmitter (5) for predetermining an angle (α') which is formed between a level (42) that is determined by the position of the work device (41) and the direction of the gravitational force (g). The inventive device further comprises a controller (3, 4, 6–16) for controlling the angle (α) between the level (42) of the work device (41) and the direction of the gravitational force (g) in such a way that the measured angle (α) matches the predetermined angle (α').

27 Claims, 3 Drawing Sheets

FOREIGN PATENT DOCUMENTS

| | | |
|---|---|---|
| DE | 39 38 766 A1 | 5/1991 |
| DE | 40 30 954 A1 | 4/1992 |
| DE | 197 52 439 A1 | 6/1999 |
| EP | 0 604 402 A1 | 6/1994 |
| GB | 1 488 202 | 10/1977 |
| GB | 2 187 375 A | 9/1987 |
| JP | 61 221424 | 10/1986 |
| JP | 63 097729 | 4/1988 |

* cited by examiner

DEVICE AND METHOD FOR CONTROLLING THE POSITION FOR WORKING DEVICES OF MOBILE MACHINES

BACKGROUND OF THE INVENTION

1. Field of the Invention

The invention relates to a position-regulating device for working mechanisms of mobile machines and a method of regulating the position of working mechanisms of mobile machines.

2. Discussion of the Prior Art

A micro-mechanical incline sensor, in particular for motor vehicles, is known as such from DE 197 52 439 A1, and has a bearing plate, the inclination of which is determined relative to the horizontal. At least two pressure sensor units are integrated on the bearing plate to determine a pressure applied to the plate at the respective points. An earth plate is connected to the bearing plate via the pressure sensor units. An evaluation unit uses the data produced by the pressure sensor units to determine the inclination of the bearing plate relative to the horizontal. Depending on the inclination of the device in which the inclination sensor is integrated, the earth plate applies a different degree of force to the respective sensor unit. At least two pressure sensors must be provided in order to measure the angle of inclination. In DE 197 52 439 A1, these are provided in the form of piezo-resistive pressure detectors.

A level-regulating device for a quay crane is known from DE 39 38 766 A1. In this case, levelling is regulated using a hydraulic control valve to actuate one or more hydraulic actuators for a part which is to be maintained at a specific level, the part being coupled with another part by which it can be adjusted to any position. To ensure a high degree of operating safety without using expensive electronic systems, the control valve is mechanically linked to and actuated by a pendulum, as its operating mechanism, the position of which is determined by gravity.

When the device is at an incline, the pendulum effects a damped deflection in a fixed direction in space, which is transmitted via the control valve to the hydraulic actuator. In DE 39 38 766 A1, a loading and unloading crane, particularly one which is suitable for loading and discharging ships, fitted with this feature, is set up so that when the crane boom is raised and lowered, a loading and unloading device disposed thereon remains in a fixed position relative to the rest of the structure.

One particular disadvantage of the level-regulating device known from DE 39 38 766 A1 is the one-dimensional orientation. In the embodiment described as an example in the above-mentioned patent specification of providing a levelling means on a loading and unloading crane, preferably used for ships, the device is totally satisfactory but for mobile machinery such as earth moving machines, for example, which preferably have to move around building sites and hence on uneven ground, one-dimensional level correction is not sufficient.

SUMMARY OF THE INVENTION

Accordingly, the objective of the present invention is to propose a device and a method for regulating the position of working mechanisms of mobile machines, by means of which the working mechanisms can be reliably adapted to both more than one direction and to the ground below on which they are travelling, depending on the respective position of the machine, without losing load on uneven terrain.

The invention is based on the knowledge that in preventing load losses, it is not just the orientation of a working mechanism of a mobile machine when it is not moving or when picking up material that is important, but also specifically when transporting the received material in the terrain. Consequently, a device that is to be suitable for this purpose must permit orientation with respect to a defined plane relative to the force of gravity and within a satisfactorily short time. The device proposed by the invention and the corresponding method constitute an arrangement that will enable a position to be corrected relative to a plane perpendicular to the force of gravity and if necessary inverse acceleration.

The possibility of designing the comparator device both as a conventional analogue system and as an integrated circuit is an advantage because it allows the special requirements of individual machines to be met.

The arrangement is easy to set up and can be readily fitted with standard sensors.

The arrangement is suitable for designs operating in one spatial direction and in two spatial directions. Especially with earth-moving machines, it is of advantage to be able to apply a position correction in the longitudinal and transverse directions. In one especially preferred embodiment, natural vibrations and their multiples induced by the control running time are eliminated.

By particular preference, the predetermined angle is adjusted so that the plane defined by the position of the working mechanism is perpendicular to the resultants of gravitational force and inverse acceleration force.

BRIEF DESCRIPTION OF THE DRAWINGS

Examples of preferred embodiments of the device proposed by the invention are illustrated in the drawings and will be explained in more detail below with reference to the drawings. They allow the working mechanism to be positioned so as to prevent load loss, even when the working mechanism is being accelerated, e.g. during travel motion.

Of the drawings.

DETAILED DESCRIPTION OF THE INVENTION

Figure 1:
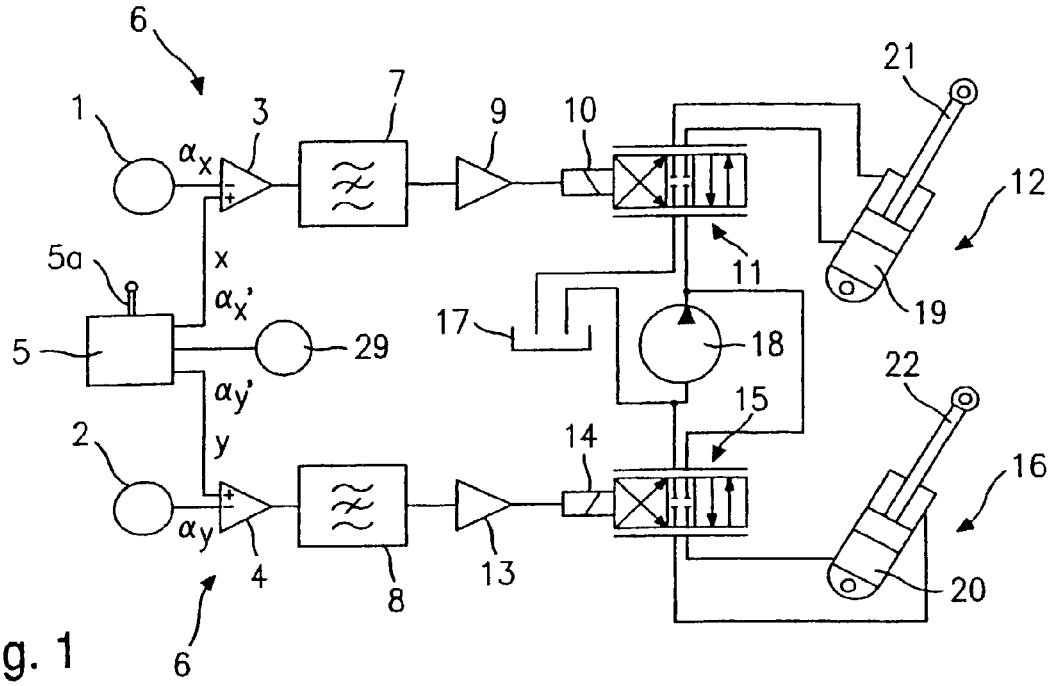
FIG. 1 is a first circuit diagram of a first embodiment of the device proposed by the invention as a means of controlling and activating hydraulic actuators to regulate the position of displaceable working mechanisms of mobile machines.

FIG. 1 is a first circuit diagram of a first embodiment of the position-regulating device proposed by the invention for working mechanisms of mobile machines. The circuit has a first sensor 1, which measures a first angle in a first spatial direction, hereafter denoted by x. This first angle will be referred to hereafter as $\alpha_x$. Similarly, a second sensor 2 measures a second angle in a second spatial direction y. The second angle is referred to hereafter as $\alpha_y$. The measured angles $\alpha_x$ and $\alpha_y$ are compared by means of a first comparator 3 and a second comparator 4 with an angle $\alpha_x'$ for the spatial direction x and $\alpha_y'$ for the spatial direction y fixed by an angle detector 5, which may be 90° respectively, for example. The comparators 3 and 4 form a comparator unit 6. The angle detector 5 may provide either a fixed, predetermined or manually variable angle $\alpha_x'$ or $\alpha_y'$ using manually controlled detector 5*a*.

After the first comparator 3, the signal in x-direction is run through a first band-stop filter 7 whilst the signal in y-direction is run through a second band-stop filter 8 after the second comparator 4. The purpose of the band-stop filters 7 and 8 is to eliminate the natural vibration $f_R$ and optionally its multiples 2 $f_R$, 3 $f_R$, . . . induced in the system by the control running time $\tau$ so that the dynamic behaviour of the system remains controllable, avoiding the occurrence of resonances.

Having been run through the band-stop filter 7, the signal in x-direction is amplified by a first amplifier 9 so as to be able to actuate a first solenoid 10. The first solenoid 10 is needed to operate a first control valve 11 which in turn actuates a first hydraulic actuator 12 to correct the position in the first spatial direction x. Similarly, after being run through the band-stop filter 8, the signal in y-direction is amplified by a second amplifier 13 in order to actuate a second solenoid 14 and hence a second control valve 15. The second control valve 15 operates a second hydraulic actuator 16. The working mechanism is oriented in the second spatial direction y as a result.

In order to operate the hydraulic actuators 12 and 16, a hydraulic fluid disposed in a tank 17 is compressed by a pump 18 in a front or rear cylinder chamber of a first cylinder 19 of the first hydraulic actuator 12 and in the front or rear cylinder chamber of a second cylinder 20 of the second hydraulic actuator 16. Consequently, a first piston 21 and a second piston 22 are subjected to a change of position, which in turn regulates the position of the working mechanism 41.

The position continues to be regulated until the comparators 3 and 4 detect no difference between the measured angle $\alpha_x$ and $\alpha_y$ and the pre-set angle $\alpha_x'$ and $\alpha_y'$. In terms of amount, the differences $\alpha_x'-\alpha_x$ or $\alpha_y'-\alpha_y$ will be almost zero or will lie at least below a value which is still tolerable for an angular variance $\Delta\alpha$, for example ±3°.

Once this state is reached, there is no further change in the signal at the control valves 11 and 15, which then switch back into a neutral position without further altering the position of the actuators 12 and 16 as they do so. The system remains in the neutral position until a modified signal arrives from the comparators 3 and 4 again.

Figure 2:
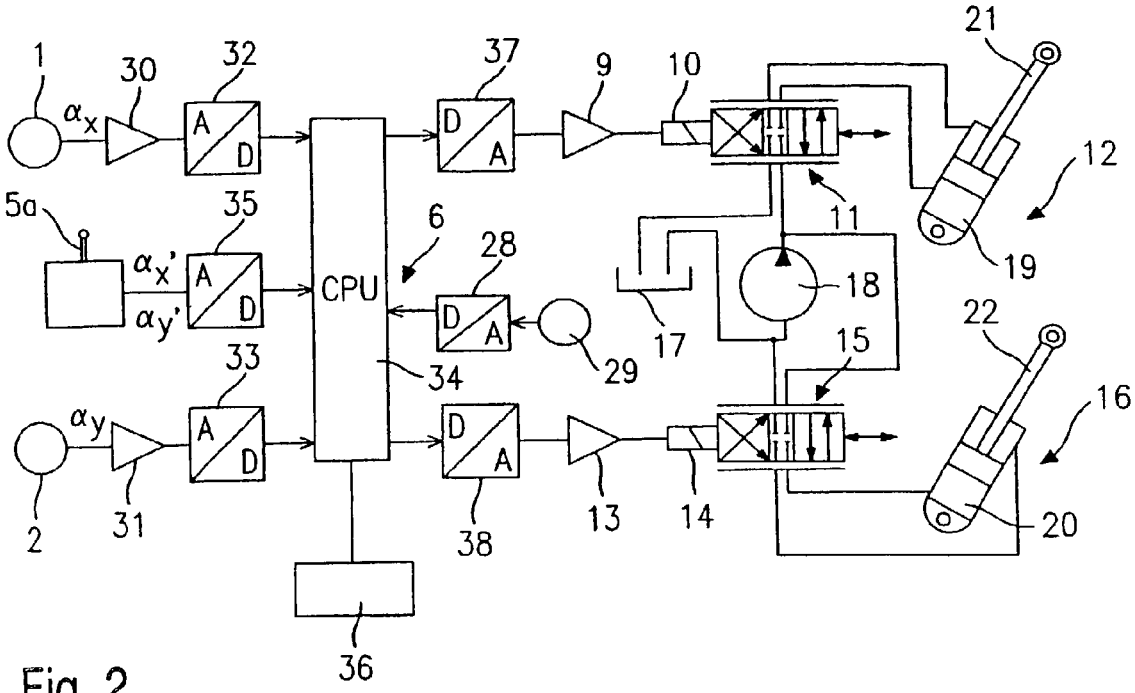
FIG. 2 is a second circuit diagram of a second embodiment of the device proposed by the invention.

FIG. 2 illustrates a second embodiment of a position-regulating device proposed by the invention for working mechanisms of mobile machines. The same reference numbers are used for components described with reference to FIG. 1 and will not be described again below. Whilst the embodiment of FIG. 1 is built using analogue technology, the embodiment illustrated in FIG. 2 is based on digital technology.

The device illustrated in FIG. 2 primarily differs from the device shown in FIG. 1 due to the use of a digital control unit 34, which assumes the function both of the band-stop filters 7 and 8 and the comparator unit 6.

Accordingly, the comparator unit 6 is built as follows. The angle $\alpha_x$ emitted by the sensor 1 is pre-amplified in a first pre-amplifier 30 and then converted by a first analogue-to-digital converter 32 from an angular value measured in analogue to a digital value that can be processed by a digital control unit 34. Similarly, the angle $\alpha_y$ is amplified by a second pre-amplifier 31 and converted by a second analogue-to-digital converter 33 into a digital value. In order to be able to compare the pre-set angle $\alpha_x'$ or $\alpha_y'$ with the angles $\alpha_x$ or $\alpha_y$ detected by the sensors 1 and 2, the pre-set angle $\alpha_x'$ and $\alpha_y'$ issued by the angle detector 5 is also converted by a third analogue-to-digital converter 35 and applied to the digital control unit 34, which may be a microprocessor.

In addition to comparing the angular values, the digital control unit 34 also filters the signals. To this end, the filter unit is a digital filter with a band-stop characteristic. As with the embodiment illustrated in FIG. 1, the band-stop characteristic correspond to the second order digital band-stop filter illustrated as an example of an embodiment in FIGS. 3A and 3B, for example, provided by a corresponding programme in the control unit 34. The digital control unit 34 has a storage 36, which, for example, offers the possibility of storing the measured and compared data so that it can be made available for subsequent external additional processing.

The compared signals from the sensors 1 and 2 are converted into analogue signals by a first digital-to-analogue converter 37 and a second digital-to-analogue converter 38. The analogue signals are amplified by amplifiers 9 and 13 and forwarded to the solenoids 10 and 14. Similarly to the first embodiment, hydraulic actuators 12 and 16 are actuated by the control valves 11 and 15, the pump 18 and the tank 17. They then correct the position of the working mechanism 41.

Figure 3A:
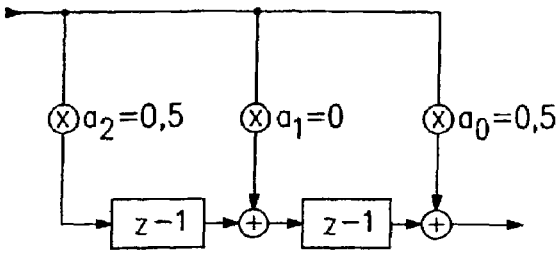
FIGS. 3A–3B illustrate the main structure of a digital filter unit designed as a 2nd order band-stop filter and the associated amplitude response.
Figure 3B:
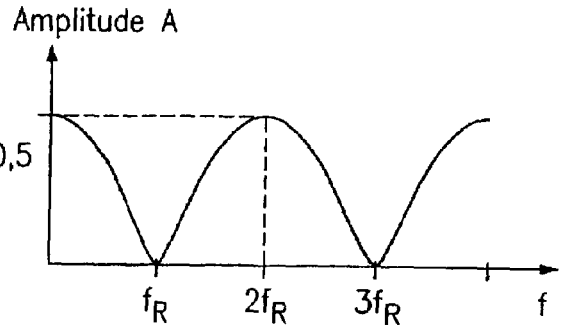

FIG. 3A illustrates the operating principle of a second order digital bandpass filter and FIG. 3B the associated frequency response. FIG. 3A shows a digital filter which creates a band-stop by means of various delay elements for delaying the sampling values (denoted by $z^{-1}$ in FIG. 3A) and coefficient elements $a_0$, $a_1$, and $a_2$ for changing the amplitude of the sampling values, having the resonance frequency $f_R$ shown in FIG. 3B. As a result, the natural vibration $f_R$ of the system, induced by the control running time $\tau$, and its uneven multiples ($3f_R$, $5f_R$, etc.) are filtered out. This prevents any build-up in the system. As a result, functioning of the device is highly dynamic on the one hand and extremely accurate on the other. Another digital filter may be provided to filter out the doubled resonance frequency $2f_R$.

How the invention is applied in one dimension will be explained in more detail with reference to a machine 40 schematically illustrated in FIG. 4 with a bucket as the working mechanism 41.

Figure 4A:
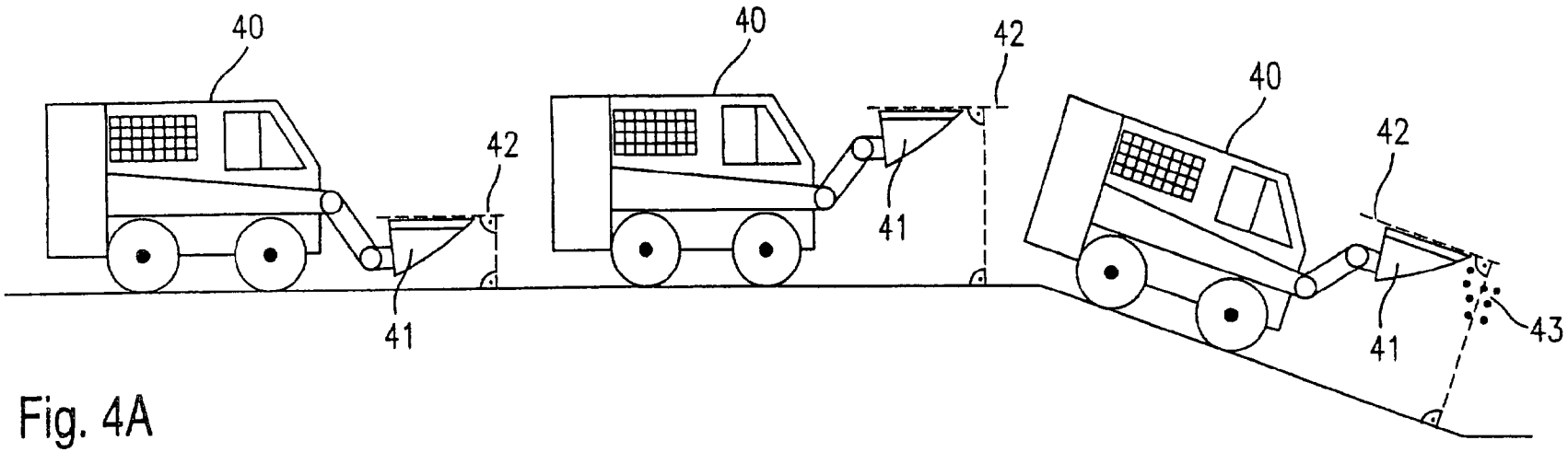
FIGS. 4A–4B provide a simplified diagram of the motion of a mobile work machine on the ground as known from the prior art and how the position-regulating device proposed by the invention is applied with a mobile machine as it moves on the ground.

FIG. 4A illustrates the existing prior art. When the bucket 41 is in the lower position (left-hand side of the diagram), the bucket 41 is aligned so that an imaginary plane 42 extending across the opening at the top of the bucket 41 is always parallel with the surface of the ground. Standard machines 40 commonly have a lifting mechanism for the working mechanism 41, which is designed so that the bucket 41 is lifted in such a way that the plane 42 determined by the opening of the bucket 41 always remains parallel with the ground.

As long as the machine 40 is travelling on a flat stretch, there are no inherent problems. However, as soon as the machine 40 starts to move up or, as illustrated in FIG. 4A, down an incline, material 43 is lost because the plane 42 determined by the bucket 41 remains parallel with the ground as before and the material 43 being transported in the bucket 41 falls out with effect from a specific incline. The angle of inclination starting from which the load will be lost depends on the shape of the bucket 41 and how full it is.

Figure 4B:
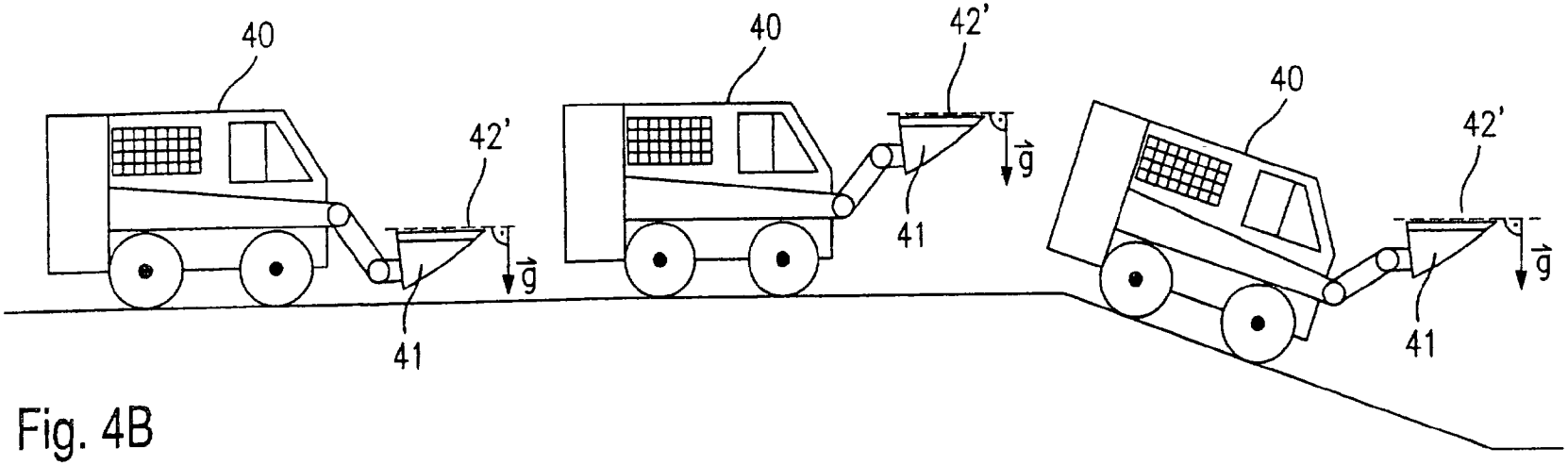

A different reference plane 42' for aligning the bucket 41 is proposed for the purposes of the invention, as illustrated in FIG. 4B. As in FIG. 4A, an imaginary plane 42' extending across the top opening of the bucket 41 is defined on the working mechanism 41 of the machine 40 illustrated in FIG. 4B. It is no longer necessarily parallel with the ground but is always oriented almost perpendicular to the direction of gravitation, denoted by the vector g in FIG. 4B. This can be obtained in both the lower and in the upper position of the bucket 41. The advantage of this is that the bucket 41 proposed by the invention is always additionally controlled when travelling uphill or downhill and when travelling on uneven terrain so that the plane 42 extending through the bucket 41 is always oriented perpendicular to the direction of gravitational acceleration g. This avoids transport losses from the bucket 41.

The one-dimensional correction to the position of the bucket 41 illustrated in FIG. 4 can also be applied without problem in two directions perpendicular to one another, for example longitudinally and transversely to the direction of displacement.

Figure 5:
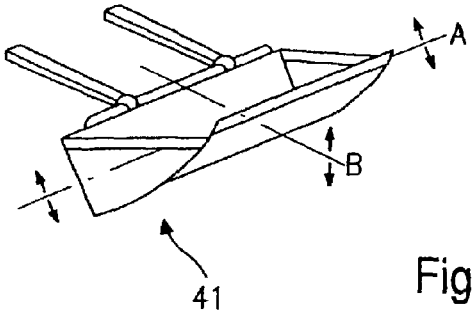
FIG. 5 is a perspective illustration showing an example of a working mechanism of a mobile machine with the possible pivot directions.

FIG. 5 provides a schematic illustration of a bucket 41 for this purpose, in perspective. The bucket 41 can be pivoted up and down through the axes A and B parallel with and perpendicular to the direction of displacement, both transversely to the travel direction and in the travel direction. Consequently load losses from the front and to the side of the bucket 41 can be prevented during travel on uneven terrain.

Figure 6:
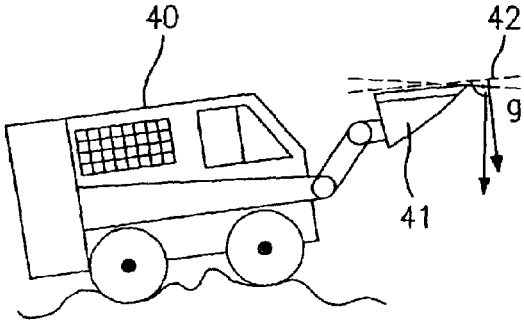
FIG. 6 is a schematic illustration of a mobile machine with the position-regulating device proposed by the invention on uneven terrain.

FIG. 6 is a schematic illustration of a machine 40 travelling on uneven terrain, where the position of the working mechanism 41 is again controlled by means of its position relative to gravitation g. In this connection, it is of practical advantage for the angle $\alpha$ between the plane 42 defined by the bucket 41 and the direction of gravitation g to assume a threshold value for the angular variance $\Delta\alpha$ with effect from which position regulation can be dispensed with. Consequently, a practical balance can be struck between uninterrupted position correction, which requires a lot of energy and can be impractical because of the delay in regulation, and loading loss due to lack of position correction. Resonant rises, which might occur if the control excitation induced by the unevenness of the ground coincides with the resonance frequency $f_R$ of the system, can be suppressed by the described filter.

Figure 7:
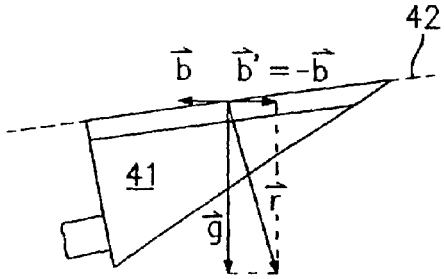
FIG. 7 is a sketch illustrating load control making allowance for acceleration.

Whilst the plane 42 defined by the orientation of the bucket 41 is perpendicular to the direction of gravitational force g in the embodiment illustrated in FIG. 6, another improved position correction can be applied if the plane 42 defined by the bucket 41 is not perpendicular to the gravitational force g but is oriented perpendicular to the resultants r of the gravitational force g and the inverses b' of the acceleration force b. The bucket 41 is illustrated on a larger scale in FIG. 7. It is assumed that the mobile machine 40 is subject to a delay due to a braking procedure. Consequently, the delaying acceleration force b acts on the bucket 41. Relative to the reference system of the bucket 41, an inverse acceleration force b' acts in the inverse direction to the acceleration force b delaying the bucket 41 due to the mass inertia, and acts on the bulk material introduced into the bucket 41, i.e. the acceleration force b' acting on the bulk material in the reference system of the bucket 41 has the same value as the acceleration force b acting on the bucket 41 in the delaying direction but rotated by 180°.

Consequently, the resultant r of the gravitational force g and the inverse acceleration force b' act on the bulk material disposed in the bucket 41. It is therefore of advantage if the plane 42 is incorporated in the position regulation proposed by the invention in such a way that the plane 42 is perpendicular to the resultant r. To this end, another measuring system 29 is provided with the embodiments illustrated in FIGS. 1 and 2 for measuring the acceleration or delay of the mobile machine 40. The acceleration or delay may also be measured separately in the dimensions x and y. Whilst the measuring system 29 for measuring acceleration is connected directly to the angle detector 5 in the embodiment illustrated in FIG. 1 using analogue technology and the pre-set angle $\alpha_x'$ in the x-direction and the pre-set angle $\alpha_y'$ in the y-direction of the angle detector 5 are over-controlled, the measuring system 29 for measuring acceleration in the embodiment of FIG. 2 based on digital technology is connected to the control unit 34 via an analogue-to-digital converter 28, which computes a correction of the pre-set angles $\alpha_x'$ and $\alpha_y'$ depending on the measured acceleration.

This additional feature ensures that the position of the bucket or generally the working mechanism 41 is regulated so that bulk material does not fall out even in the event of higher accelerations or delays of the mobile machine 40.

The invention is not restricted to the embodiments illustrated as examples here but may be applied to any machines using different sensors or filter systems.

What is claimed is:

1. Device for regulating the position of working mechanisms (41) of mobile machines (40) with a measuring system (1, 2) for measuring an angle ($\alpha$) subtended between a plane (42) defined by the position of the working mechanism (41) and the direction of gravitational force (g), an angle detector (5) for pre-setting an angle ($\alpha'$) subtended between a plane (42) defined by the position of the working mechanism (41) and the direction of gravitational force (g), and a regulating system for regulating the angle ($\alpha$) between the plane (42) of the working mechanism (41) and the direction of gravitational force (g) so that the measured angle($\alpha$) is brought into alignment with the pre-set angle ($\alpha'$), characterised in that another measuring system (29) is provided for measuring the acceleration and/or delay of the mobile machine (40) and in that the pre-set angle ($\alpha'$) is adjusted so that the plane (42) defined by the position of the working mechanism (41) extends perpendicular to the resultants (r) of the gravitational force (g) and the measured inverse acceleration force (b'), wherein the device for regulating the position of the working mechanisms (41) compensates for inclinations longitudinally and transversely to the direction of displacement of the machine (40), a first actuator (12) being actuated to apply a position correction in a first spatial direction (x) and a second actuator (16) being actuated to apply a position correction in a second spatial direction (y).

2. Device as claimed in claim 1,
characterised in that
the regulating system has a comparator unit (6) for comparing the measured angle ($\alpha$) with a preset angle ($\alpha'$) and at least one electromagnetic control valve actuated by the comparator unit (6), which acts on a hydraulic actuator.

3. Device as claimed in claim 2,
characterised in that
the comparator unit (6) is provided in the form of comparators (3, 4).

4. Device as claimed in claim 2,
characterised in that
the comparator unit (6) is a digital control unit.

5. Device as claimed in one of claims 1 to 4,
characterised in that
the regulating system has a filter unit which eliminates a natural vibration ($f_R$) induced by the control running time ($\tau$).

6. Device as claimed in claim 5,
characterised in that
the filter unit is provided as a band-stop filter for the natural vibration ($f_R$) and/or multiples thereof.

7. Device as claimed in claim 6,
characterised in that
the filter unit is a digital filter with a band-stop characteristic.

8. Device as claimed in claim 1,
characterised in that
a measuring system (1) is provided for measuring the angle ($\alpha_x$) in the first spatial direction (x) and a second measuring system (2) for measuring the angle ($\alpha_x$) in the second spatial direction (y).

9. Device for regulating the position of working mechanisms (41) of mobile machines (40) with a measuring system for measuring an angle ($\alpha$) subtended between a plane (42) defined by the position of the working mechanism (41) and the direction of gravitational force (g), an angle detector (5) for pre-setting an angle ($\alpha'$) subtended between a plane (42) defined by the position of the working mechanism (41) and the direction of gravitational force (g), and a regulating system for regulating the angle ($\alpha$) between the plane (42) of the working mechanism (41) and the direction of gravitational force (g) so that the measured angle ($\alpha$) is brought into alignment with the pre-set angle ($\alpha'$),
characterised in that
another measuring system (29) is provided for measuring the acceleration and/or delay of the mobile machine (40),
wherein the pre-set angle ($\alpha'$) is adjusted so that the plane (42) defined by the position of the working mechanism (41) extends perpendicular to the resultants (r) of the gravitational force (g) and the measured inverse acceleration force (b');
wherein regulating the position of working mechanisms (41) of mobile machines (40) compensates for inclinations longitudinally and transversely to the direction of displacement of the machine (40), and a first actuator (12) being actuated to apply a position correction in a first spatial direction (x) and a second actuator (16) being actuated to apply a position correction in a second spatial direction (y).

10. Device as claimed in claim 9,
characterised in that
a measuring system (1) is provided for measuring the angle ($\alpha_x$) in the first spatial direction (x) and a second measuring system (2) for measuring the angle ($\alpha_x$) in the second spatial direction (y).

11. Device as claimed in claim 9,
characterised in that
the regulating system has a comparator unit (6) for comparing the measured angle ($\alpha$) with a pre-set angle ($\alpha'$) and at least one electromagnetic control valve actuated by the comparator unit (6), which acts on a hydraulic actuator.

12. Device as claimed in claim 11,
characterised in that
the comparator unit (6) is provided in the form of comparators.

13. Device as claimed in claim 11,
characterised in that
the comparator unit (6) is a digital control unit.

14. Device as claimed in claim 9,
characterised in that
the regulating system has a filter unit which eliminates a natural vibration ($f_R$) induced by the control running time ($\tau$).

15. Device as claimed in claim 14,
characterised in that
the filter unit is provided as a band-stop filter for the natural vibration ($f_R$) and/or multiples thereof.

16. Device as claimed in claim 15,
characterised in that
the filter unit is a digital filter with a band-stop characteristic.

17. Device as claimed in claim 9,
characterised in that
the device for regulating the position of working mechanisms (41) of mobile machines (40) compensates for inclinations longitudinally and transversely to the direction of displacement of the machine (40), a first actuator (12) being actuated to apply a position correction in a first spatial direction (x) and a second actuator (16) being actuated to apply a position correction in a second spatial direction (y).

18. Device as claimed in claim 17,
characterised in that
a measuring system (1) is provided for measuring the angle ($\alpha_x$) in the first spatial direction (x) and a second measuring system (2) for measuring the angle ($\alpha_x$) in the second spatial direction (y).

19. Method of regulating the position of working mechanisms (41) of mobile machines (40) having the following method steps:
measuring an angle ($\alpha$) subtended between a plane (42) defined by the position of the working mechanism (41) and the direction of gravitational force (g),
setting an angle ($\alpha'$) subtended between a plane (42) defined by the position of the working mechanism (41) and the direction of gravitational force (g) and
regulating the angle ($\alpha$) between the plane (42) of the working mechanism (41) and the direction of gravitational force (g) so that the measured angle ($\alpha$) is brought into alignment with the pre-set angle ($\alpha'$),
characterised in that
the pre-set angle ($\alpha'$) is adjusted so that the plane (42) defined by the position of the working mechanism (41) extends perpendicular to the resultants (r) of the gravitational force (g) and inverse acceleration force (b');
wherein regulating the position of the working mechanisms (41) of mobile machines (40) compensates for inclinations longitudinally and transversely to the direction of displacement of the machines (40), actuating a first actuator (12) to apply a positional correction in a first spatial direction (x), and actuating a second actuator (16) to apply a positional correction in a second spatial direction (y).

20. Method as claimed in claim 19, characterised in that there is provided a regulating system including a comparator unit (6) for comparing the measured angle ($\alpha$) with a pre-set angle ($\alpha'$) and at least one electromagnetic control valve actuated by the comparator unit (6), which acts on a hydraulic actuator.

21. Method as claimed in claim 20, characterised in that the comparator unit (6) is provided in the form of comparators (3, 4).

22. Method as claimed in claim 21, characterised in that the regulating system has a filter unit which eliminates a natural vibration ($f_R$) induced by the control running time ($\tau$).

23. Method as claimed in claim 22, characterised in that the filter unit is provided as a band-stop filter for the natural vibration ($f_R$) and/or multiples thereof.

24. Method as claimed in claim 23, characterised in that the filter unit is a digital filter with a band-stop characteristic.

25. Method as claimed in claim 20, characterised in that the comparator unit (6) is a digital control unit.

26. Method as claimed in claim 19, characterised in that regulating the position of working mechanisms (41) of mobile machines (40) compensates for inclinations longitudinally and transversely to the direction of displacement of the machine (40), a first actuator (12) being actuated to apply a position correction in a first spatial direction (x) and a second actuator (16) being actuated to apply a position correction in a second spatial direction (y).

27. Method as claimed in claim 26, characterised in that a measuring system (1) is provided for measuring the angle ($\alpha_x$) in the first spatial direction (x) and a second measuring system (2) for measuring the angle ($\alpha_x$) in the second spatial direction (y).

* * * * *